United States Patent [19]

Chihara

[11] 4,232,383

[45] Nov. 4, 1980

[54] ELECTRONIC TIMEPIECE BATTERY MONITORING CIRCUIT

[75] Inventor: Hiroyuki Chihara, Suwa, Japan

[73] Assignee: Kabushiki Kaisha Suwa Seikosha, Tokyo, Japan

[21] Appl. No.: 899,926

[22] Filed: Apr. 26, 1978

[30] Foreign Application Priority Data

Apr. 26, 1977 [JP] Japan ..... 52-48292

[51] Int. Cl.[3] ..... G04C 23/00; G04B 1/00; G08B 21/00

[52] U.S. Cl. ..... 368/66; 368/203; 340/636; 340/641

[58] Field of Search ..... 58/23 R, 23 BA, 23.50 R, 58/152 H; 320/13, 14, 39, 40, 48; 340/636, 641; 307/10 BP

[56] References Cited

U.S. PATENT DOCUMENTS

| | | | |
|---|---|---|---|
| 3,949,545 | 4/1976 | Chihara | 58/23 BA |
| 3,979,657 | 9/1976 | Torksie | 320/13 |
| 4,041,691 | 8/1977 | Chihara et al. | 58/23 BA |
| 4,043,110 | 8/1977 | Chihara | 58/23 BA |
| 4,043,112 | 8/1977 | Tanaka | 58/23 BA |
| 4,126,874 | 11/1978 | Suzuki et al. | 354/60 R |
| 4,126,889 | 11/1978 | Ibamoro et al. | 361/92 |

*Primary Examiner*—Vit W. Miska

*Attorney, Agent, or Firm*—Blum, Kaplan, Friedman, Silberman & Beran

[57] ABSTRACT

A battery monitoring circuit for an electronic wristwatch that avoids an inadvertent indication of battery failure when a sudden, but temporary, load is placed upon the battery is provided. The invention is characterized by a monitoring circuit that produces an indication signal of impending failure of the battery in response to a detection signal being applied thereto. The detection signal is produced by a battery detection circuit when the voltage of the battery falls below a predetermined level. An inhibit circuit is coupled intermediate the voltage detection circuit and the monitoring circuit and detects when a temporary load is placed upon the battery and, in response thereto, inhibits the detection signal from being applied to the monitoring circuit to thereby prevent an indication signal, representative of imminent battery failure, from being produced as a result of an additional load being temporarily placed upon the battery.

11 Claims, 8 Drawing Figures

FIG. 1
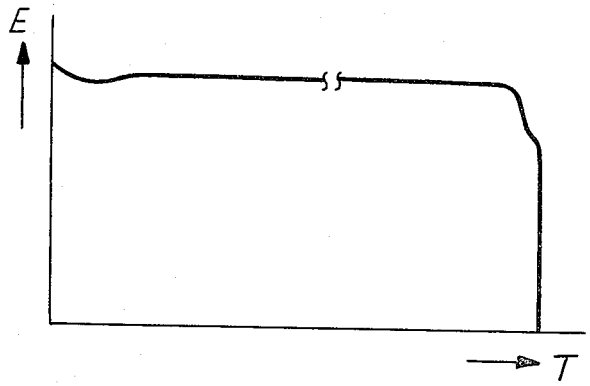
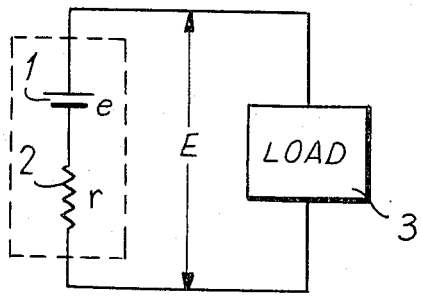
FIG. 2

ELECTRONIC TIMEPIECE BATTERY MONITORING CIRCUIT

BACKGROUND OF THE INVENTION

This invention is directed to a battery monitoring circuit for an electronic wristwatch, and in particular, to a battery monitoring circuit for an electronic wristwatch that prevents an indication of impending battery failure when a temporary, but sudden, load is placed upon the battery by a lamp, alarm or other high impedance device.

In U.S. Pat. No. 3,949,545, filed on Apr. 24, 1975, a battery voltage detecting circuit utilizing the threshold voltage of a field-effect transistor as a battery failure indicator is disclosed. By providing a battery detection circuit, an indication signal can be supplied to the display of an electronic wristwatch to thereby provide an indication to the consumer that the battery is almost dissipated, and hence should be replaced. Battery failure detection circuits of the type disclosed in U.S. Pat. No. 3,949,545 have proved to be extremely convenient and have gained widespread acceptance because of the reliability and convenience provided by same.

It is noted, however, that when a sudden, but temporary, load is placed upon a battery by a lamp or buzzer incorporated in an electronic wristwatch, a sudden, but temporary, drop in the voltage of the battery is often detected by the battery monitoring circuit and, in response thereto, an indication signal representative of imminent battery failure is inadvertently produced. Moreover, once this indication signal is produced, the consumer is likely to replace the battery even though the voltage delivered thereby is immediately returned to a satisfactory level once the temporary load placed upon the battery is removed therefrom. Accordingly, a battery monitoring circuit for an electronic wristwatch that prevents an inadvertent indication of battery failure when a temporary load is placed thereupon is desired.

SUMMARY OF THE INVENTION

Generally speaking, in accordance with the instant invention, a battery monitoring circuit for an electronic timepiece is provided. The timepiece includes a battery for producing a supply voltage. A battery detection circuit is coupled to the battery and detects when the supply voltage of the battery falls below a predetermined level and, in response thereto, produces a detection signal. The invention is particularly characterized by a monitoring circuit for producing an indication signal in response to a detection signal being applied thereto. A load is adapted to be selectively coupled to the battery and, in response thereto, place an additional load thereon. An inhibit circuit is coupled intermediate the battery detection circuit and the monitoring circuit and is further coupled to the load to detect when the load is coupled to the battery and, in response thereto, inhibit the detection signal from being applied to the monitoring circuit to thereby prevent an indication signal from being inadvertently produced when the load is selectively placed upon the battery.

Accordingly, it is an object of the instant invention to provide an improved battery monitoring circuit for an electronic wristwatch that prevents an inadvertent indication of battery failure.

A further object of the instant invention is to provide a battery monitoring circuit for an electronic wristwatch that prevents an indication signal from being inadvertently produced when a lamp, alarm or other load is temporarily placed upon the battery.

Still a further object of the instant invention is to provide a battery monitoring circuit for preventing the operation of a lamp or buzzer when the impending failure of a battery is detected.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a graphical illustration of the voltage discharge characteristics of a silver oxide battery;

FIG. 2 is an equivalent circuit diagram of a DC battery;

DETAILED DESCRIPTION OF THE PREFERRED EMBODIMENTS

Figure 3:
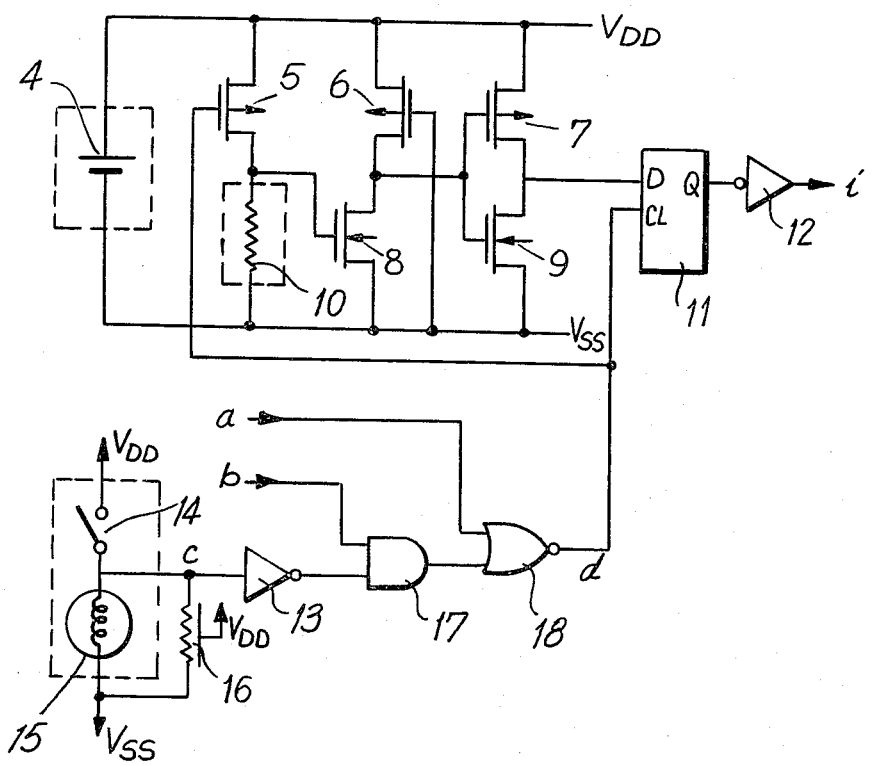
FIG. 3 is a circuit diagram of a battery monitoring circuit constructed in accordance with a first embodiment of the instant invention.

Reference is now made to FIGS. 1 and 2 of the drawings, wherein the interrelationship between the voltage delivered by a battery and the residual capacity stored in the battery is depicted. As is illustrated in FIG. 1, the voltage V delivered by a battery is slightly decreased over an extended period of use. Moreover, just prior to the complete failure of the battery, the battery will decline a predetermined amount. Heretofore, battery monitoring circuits such as the battery monitoring circuit disclosed in U.S. Pat. No. 3,949,545, which patent is incorporated by reference herein as if fully set forth, detected the decline in the capacity of the battery that occurs just prior to its failure, in order to apply an indication signal to a display means for displaying the impending failure of the battery.

As is illustrated in FIG. 1, because the discharge characteristics of a silver oxide battery utilized to drive an electronic wristwatch provides for almost the entire life of the battery, silver oxide batteries are particularly suitable for use in electronic wristwatches. Moreover, the flat curve is not lowered until the final discharge state wherein residual battery capacity represents a small percentage of the initial battery capacity, and it is this small lowering in the curve that is detected so that an indication signal is not produced until the battery is almost entirely consumed. Nevertheless, the flat discharge characteristic occurs only when a light load, or constant load, is placed upon the DC battery utilized to energize the electronic wristwatch. Moreover, the internal resistance of a silver oxide battery is of a relatively large magnitude and, accordingly, when a large current flow is required, the discharge characteristic of the curve of the silver oxide battery suddenly drops, even if there is not a substantial decrease in the battery capacity.

An equivalent battery circuit is illustrated in FIG. 2, wherein a voltage supply 1(*e*) and an internal resistance 2(*r*) define the internal resistance characteristic of a battery E utilized to drive a load resistance 3, identified as R. If the output voltage of the battery, namely, the battery across the load resistance R is E, then $$E = e - i \times R = e \times \frac{R}{r + R}$$

As the value of the load resistance R decreases, the internal resistance r becomes significant and, hence, lowers the output voltage E of the battery. Additionally, the value of the internal resistance r depends in large measure on the type of electrolyte utilized in the battery. In the case of a silver oxide battery, if the electrolyte is KOH, the internal resistance is on the order of 3Ω at ambient temperatures and about 20Ω at −10° C. However, if the electrolyte utilized in the silver oxide battery is NaOH, the internal impedance of the battery is on the order of 8Ω to 10Ω at ambient temperatures and more than 100Ω at −10° C., notwithstanding the fact that the voltage e is about 1.5V in either case. Thus, for the case of an electronic wristwatch having a liquid crystal display, during ordinary operation, the average current consumed thereby is about 3μA, with a peak current consumption of 100μA. Moreover, if the voltage of the battery is 1.5V, the load resistance, during peak current flow, is on the order of 15 KΩ. In such event, the output voltage of a battery with a NaOH electrolyte at −10° C. is obtained according to the following formula:

$$E = 1.58\text{V} \times \frac{15K\Omega}{100\Omega + 15K\Omega} = 1.57\text{V}$$

Accordingly, even under these conditions, the voltage drop is negligible during ordinary operation. However, when a heavy load is placed upon the battery, such as by illuminating a lamp utilized to lighten a liquid crystal display, or when actuating a buzzer alarm, the load resistance is increased to an impedance level of 100Ω and, hence, requires a current of 10 mA to 15 mA to flow. When R equals 100Ω, the output voltage E is represented by the following table:

TABLE 1

| Temperature/Electrolyte | −10° C. | 0° C. | 25° C. |
|---|---|---|---|
| NaOH | r ≈ 100Ω<br>E ≈ 0.79V | r ≈ 50Ω<br>E ≈ 1.05V | r ≈ 8Ω<br>E ≈ 1.46V |
| KOH | r ≈ 20Ω<br>E ≈ 1.32V | r ≈ 10Ω<br>E ≈ 1.44V | r ≈ 3Ω<br>E ≈ 1.53V |

As illustrated in Table 1, when an NaOH electrolyte is utilized in a silver oxide battery, it admits of a considerable voltage drop when a heavy load is placed thereupon and it is not used to energize an electronic timepiece having a lamp, alarm or other high impedance load device. A silver oxide battery having a KOH is therefore preferred for powering an electronic wristwatch. However, silver oxide batteries having a KOH electrolyte are less than completely satisfactory since they have a large self-discharge characteristic. The lowering of the discharge characteristic of the battery occurs as a result of the increase in the internal resistance of the battery resulting from the voltage drop thereacross. Additionally, the voltage is lowered as a result of the chemical changes in the battery resulting from the large current flow, which changes will be described in greater detail below.

It is noted that the minimum operating voltage of a quartz crystal oscillator circuit, of the type found in an electronic wristwatch, is on the order of 0.8 V to 1.2 V. Accordingly, battery voltage detecting circuits are provided for detecting when the voltage delivered by the DC battery is lowered to a level of 1.3 V to 1.45 V. Even in KOH batteries, if a large current flow is effected at a low temperature, the output voltage is lowered to about 1.3 V to 1.45 V. Accordingly, the lowering of the voltage delivered by the DC battery has no influence on the timekeeping circuitry and the timekeeping function performed thereby. However, battery monitoring circuits of the type provided in U.S. Pat. No. 3,949,545 are likely to produce an indication signal in response to a lowering of the battery voltage even though the voltage delivered by the battery is only temporarily lowered and the battery is not yet in its last discharge stage. The instant invention is particularly characterized by a battery monitoring circuit that prevents an indication signal representative of impending battery failure from being inadvertently produced in response to a sudden and large current flow being effected by a temporary load placed upon the battery.

Reference is now made to FIG. 3, wherein a battery monitoring circuit constructed in accordance with the first embodiment of the instant invention is depicted. A DC battery 4 for energizing the electronic wristwatch is adapted to be monitored by the battery monitoring circuit. A first stage is defined by a P-MOS enhancement transistor 5 and variable resistor 10 coupled in parallel with the power supply 4. A second stage includes a C-MOS inverter comprised of P-channel enhancement transistor 6 and N-channel enhancement transistor 8. The gate electrode of N-channel transistor 8 is coupled to the drain electrode of P-channel transistor 5 and to the variable resistor 10. A third stage of the voltage detection circuit is defined by P-channel enhancement transistor 7 and N-channel enhancement transistor 9, which transistors define a C-MOS inverter and are adapted to invert the signal applied to the commonly coupled gate input thereof and apply same to the D input of latch circuit 11. Latch circuit 11 will write-in the signal applied to the D input when the signal applied to the clock input CL is at a LOW binary level. C-MOS inverter 12 is coupled to the Q output of latch circuit 11 to define a monitoring circuit and produces, at the output thereof, an indication signal i representative of the impending failure of the battery being detected. A visual indication means (not shown) is provided in the display (not shown) of the electronic wristwatch for displaying to the consumer the impending failure of the battery so that a battery can be replaced when the indication signal i, produced at the output of C-MOS inverter 12, is a HIGH level signal.

The gate electrode of P-MOS transistor 5 is coupled to the output of a NOR gate 18, to receive the output signal d produced thereby. Additionally, the output signal d of the NOR gate is also applied as a clock signal to the clock terminal CL of the latch circuit 11. The NOR gate 18 is formed of C-MOS elements and receives, as a second input, the output of an AND gate 17 comprised of C-MOS elements. Coupled to the second input of AND gate 17 is a C-MOS inverter-amplifier 13, for detecting the load condition placed upon the battery by a lamp 15. Lamp 15 is coupled between a positive terminal of the battery $V_{DD}$ and a negative or reference terminal of the battery $V_{SS}$ and is further coupled to an ON-OFF switch 14. A pull-down resistance is coupled across the lamp 15 and is defined by the ON resistance of an MOS transistor so that each of the elements, illustrated in FIG. 3, with the exception of lamp 15, switch 14 and resistor 10 surrounded by dotted lines is integrated into the same IC chip as the timekeeping circuitry of the electronic wristwatch.

Voltage detection of the battery's voltage is performed by MOS transistors 5 through 9, variable resistor 10, latch circuit 11 and C-MOS inverter 12 in the following manner. Changes in the voltage delivered by the battery are amplified by the first stage comprised of P-MOS transistor 5 and the manually adjustable resistor 10, whereafter the output thereof is compared with the binary logic level of the C-MOS inverter comprised of P-channel transistor 6 and N-channel transistor 8 to thereby produce a HIGH or LOW binary output signal representative of whether or not the voltage level detected by the first stage is above or below a predetermined logic level. Thereafter, a third stage comprised of P-channel transistor 7 and N-channel transistor 9 define a further C-MOS inverter and invert the output of the second stage and apply same to the D input of latch circuit 11. Each time that a LOW level clock signal is read into the latch circuit 11, the output of the third inverter stage is stored in the latch circuit. During normal operation, when the voltage characteristic of the battery is above the predetermined level that would signify the impending failure of the battery, the first stage produces a HIGH level signal which is inverted, in turn, by the second stage and third stage, so that a HIGH level signal is stored in the latch circuit 11. In such event, a LOW level indication signal is produced at the output of C-MOS inverter 12, so that no indication of impending failure of the battery is provided. However, when the voltage delivered by the battery drops below the predetermined level of the first stage, a LOW level signal is applied to the second stage and is, in turn, inverted by same and applied as a LOW level signal to the D terminal of latch circuit 11. The latch circuit 11 will therefore apply a LOW level signal to C-MOS inverter 12 resulting in a HIGH level indication signal i being produced, which signal would then be applied to suitable indication means for indicating the impending failure of the battery. Accordingly, the external resistance 10 permits a predetermined level, representative of impending battery failure, to be selectively adjusted in accordance with the instant invention.

In order to reduce the power consumption of the voltage detection circuit, a differential pulse signal is applied to the voltage detection circuit so that same is only operative for a period of 1.9 m-sec. or 3.8 m-sec. during each one second interval and, it is for this purpose that a latch circuit 11 is provided. Specifically, by reading the signal representative of the voltage level into the latch circuit 11, once during the 1.9 m-sec. or 3.8 m-sec. interval that the voltage detection circuit samples the voltage supplied by the battery, a significant reduction in energy consumption is obtained. However, in view of the short sampling period, a HIGH level adjustment detection signal a is applied to NOR gate 18 to assure that a LOW level signal is continually applied to P-channel transistor 5 when the external resistance 10 is being adjusted to select a predetermined voltage detection level. Once adjustment of the resistance 10 is completed, the adjustment detection signal a is returned to a LOW level signal in order to permit the EXCLUSIVE NOR gate 18 to be controlled by the output of AND gate 17, in a manner to be discussed in greater detail below.

Figure 4:
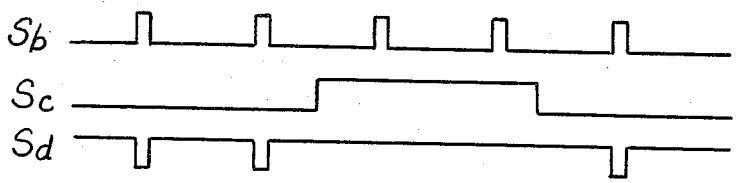
FIG. 4 is a wave diagram illustrating the operation of the battery monitoring circuit depicted in FIG. 3.

The differential pulse sampling signal b is illustrated in FIG. 4 as signal $S_b$ and is applied as a first input to AND gate 17 in order to control the duration of voltage detection and limit same to 1.9 m-sec. or 3.8 m-sec. depending upon the width of the pulses in the signal $S_b$. When the lamp 15 is turned off, a LOW level signal $S_c$ is applied to the inverter 13 to thereby reference the second input of AND gate 17 to a HIGH level. Accordingly, in response to each high level sample pulse $S_b$ applied to AND gate 17, a HIGH level pulse is applied to the second input of NOR gate 18 and unless a HIGH adjustment detection signal is being applied to the EXCLUSIVE NOR gate 18, a LOW level detection signal pulse $S_d$ is applied at the output of NOR gate 18 to the gate electrode of P-channel transistor 5 and the clock terminal of latch circuit 11. Thus, the P-channel transistor 5 is turned ON whenever a LOW level signal is applied to the gate electrode thereof and during the 1.9 m-sec. or 3.8 m-sec. period during each second that the LOW level pulse is applied thereto, the battery supplied by the voltage is detected and the condition of same is read into the latch circuit 11, in the manner noted above, so that an indication signal i representative of the condition of the battery is continually produced.

However, when the lamp 15 is turned ON, HIGH level signal $S_c$ is inverted by C-MOS inverter 13 and is applied as a LOW level second input to AND gate 17 which, in turn, produces a HIGH level signal $S_d$ at the output of NOR gate 18. Moreover, the LOW level signal applied to AND gate 17 inhibits the sampling pulses $S_b$ from being applied through NOR gate 18 to the P-channel transistor 5 and latch circuit 11. Instead, while the switch 14 is closed, the signal $S_d$ is maintained at a HIGH level thereby preventing the voltage detection circuit from operating. Accordingly, when the lamp is operated, the additional load placed thereon by the battery could cause the voltage discharge characteristic of the battery to drop below the predetermined level detected by the voltage detection circuit. However, since the sampling signals are prevented from being applied to the voltage detection circuit, when an additional load is placed upon the battery by the lamp 15, the inadvertent detection of a condition of impending failure of the battery is avoided.

Figure 5:
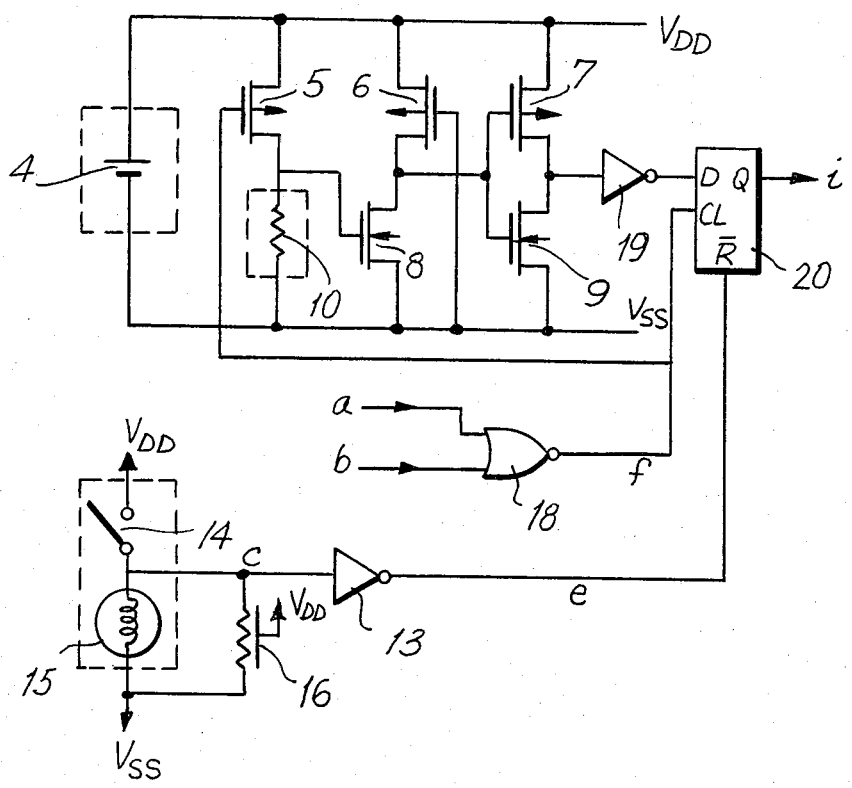
FIG. 5 is a circuit diagram of a battery monitoring circuit constructed in accordance with a second embodiment of the instant invention.
Figure 6:
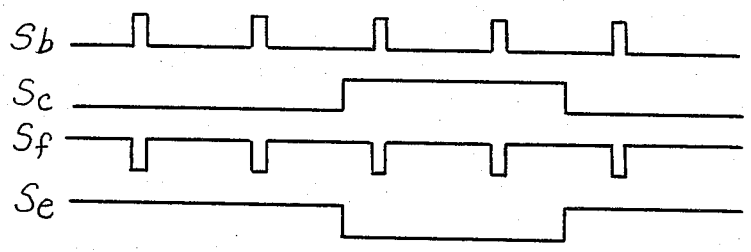
FIG. 6 is a wave diagram illustrating the operation of the battery monitoring circuit depicted in FIG. 5.

Reference is now made to FIGS. 5 and 6, wherein a further embodiment of the battery monitoring circuit of the instant invention is depicted, like reference numerals being utilized to denote like elements described above. In this embodiment, when switch 14 is closed to thereby turn on lamp 15, a HIGH level signal $S_c$ is applied to C-MOS inverter 13 and, in turn, a LOW level signal $S_e$ is applied to the $\overline{R}$ terminal of latch circuit 20 to thereby reset same when a LOW level signal is applied thereto. In response thereto the indication signal i, produced at the Q output of the latch circuit 20, remains at a LOW level even if a lowering of the voltage level supplied by the battery is detected during the interval that an additional load is placed upon the battery by energizing the lamp 15. In all other respects, the battery monitoring circuit, illustrated in FIGS. 5 and 6, operate in the same manner as the battery monitoring circuit depicted in FIG. 3.

Figure 7:
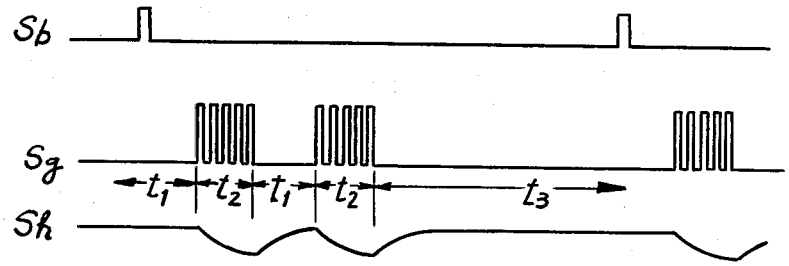
FIG. 7 is a wave diagram illustrating the operation of a battery monitoring circuit of the instant invention when an alarm buzzer places a load upon a battery.

When an alarm device is operated, such as by driving a buzzer, the manner in which sampling pulses are utilized to sample the battery voltage detected is slightly different than in the case of a lamp. Usually, buzzers and other alarm devices are driven by a signal having a frequency on the order of 2 K Hz to 4 K Hz with a 1:1 duty cycle. In such event, the peak driving current is on the order of 10 mA to 15 mA, which is on the same order of magnitude as the current consumed by a lamp. However, as a result of chemical changes in the battery resulting from the flow of a large current, the output voltage level of the battery is temporarily lowered. Moreover, the normal voltage level does not immediately return when the current drain is turned OFF but, instead, recovers after a period of time equal to about the period of time that a current drain was placed upon the battery. As is illustrated in FIG. 7, signal $S_h$ illustrates the lowering of the voltage delivered by the battery as a result of the chemical changes in the battery. In actual examples, the voltage delivered by the battery is often lowered by an amount equal to 50 mV to 100 mV when the buzzer is operated at low temperatures. Thus, when a large current flow occurs, the voltage drop due to the internal resistance is cumulative to the lower voltage effect resulting from the chemical changes in the battery. Therefore, the differential sampling of the battery voltage should not be performed when a large current is being drawn from the battery and, moreover, when an alarm buzzer is actuated, the battery voltage should not be detected until a period equal to the period that a drain was placed on the battery immediately following the turning off of the buzzer.

To this end, FIG. 7 illustrates the relationship between the application of a differential sampling signal $S_b$ and the driving of an alarm device. Specifically, the differential sampling signal of the battery has a period of one second and a 3.9 m-sec. pulse width. A driving signal $S_g$ is applied to the alarm device and provides a first blank time period of $\frac{1}{8}$ of a second ($t_1$). A second blank period $t_3$ equals one-half of a second and the driving time period $t_2$ is one-eighth of a second. The period for driving the alarm device is repeated each second and the alarm device is driven by a 4096 Hz frequency signal during the period $t_2$. As aforenoted, the signal $S_h$ represents the lowering of the voltage delivered by the battery as a result of chemical changes in the battery. Accordingly, the differential pulses are applied to the drive circuit a blank time period of 0.5 seconds after the alarm device is turned OFF. By not detecting the state of the battery until the battery is recovered from the sudden discharge of current, the inadvertent detection of impending failure of the battery is avoided.

It is noted that the instant invention requires the addition of a few circuit elements in order to permit the differential sampling of the battery voltage to be inhibited when a lamp is turned on or, additionally, to prolong the time period when the detecting circuit is reset until a temporarily lowered output voltage condition is completed. Moreover, by utilizing the reset feature of FIG. 5, the differential sampling of the detection circuit can be prevented after a large load is placed upon the battery until a sufficient period after the load is no longer placed upon the battery, in order to avoid an indication signal representative of impending battery failure from being inadvertently produced.

The instant invention is also directed to taking into account the relationship between the life of a battery, the manner in which the voltage thereof is detected in order to produce an indication signal, and the placing of a load upon the battery when a n NaOH electrolyte is utilized in the battery. As aforenoted, the internal resistance of a silver oxide battery having an NaOH electrolyte is large when a load such as a lamp is placed thereupon. Moreover, the internal resistance is even larger when the battery is operated at low temperatures, as is illustrated in Table 1, and if the output voltage characteristic of the battery is sufficiently lowered, and insufficient voltage may be provided by the battery to operate the timekeeping circuitry. Accordingly, the voltage detection circuit can be adjusted to produce an indication signal when a large current drain of the battery is required by a temporary load, and if an impending failure condition is detected, the load requiring the large current drain can be prevented from being actuated. By this mechanism, a load such as a lamp that requires a large current for operation can even be used for a silver oxide battery having an NaOH electrolyte. However, even if the load is prevented from being actuated, when the voltage characteristic of the battery is significantly lowered, in accordance with the instant invention, the battery monitoring circuit will not produce an indication signal, when a large current flow through the load is effected.

Figure 8:
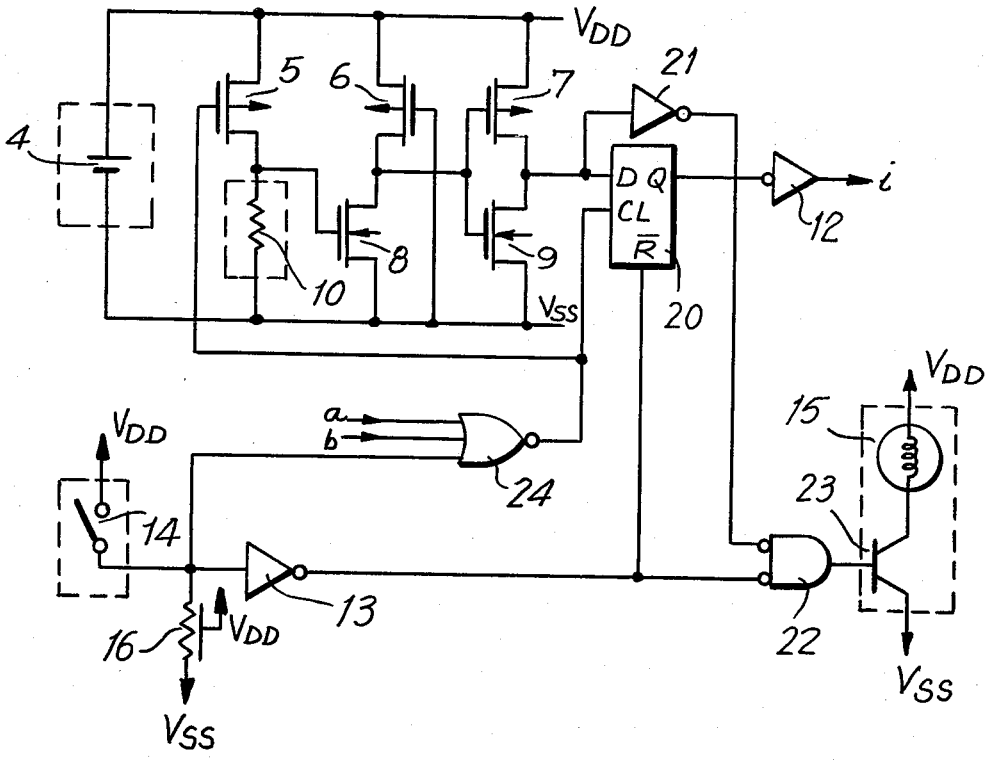
FIG. 8 is a circuit diagram of a battery monitoring circuit constructed in accordance with still a further embodiment of the instant invention.

Reference is now made to FIG. 8, wherein a battery monitoring circuit, constructed in accordance with a further embodiment of the instant invention and incorporating the features noted above, is depicted, like reference numerals being utilized to denote like elements described above. The lamp 15 is still actuated by closing the switch 14. The switch 14 is coupled through C-MOS inverter 13, AND gate 22 and current transistor 23 to the lamp 15. AND gate 22 prevents the lamp from operating when the voltage detection circuit detects a lowering of the level of the voltage produced by the battery. In the battery monitoring circuit, depicted in FIG. 8, the battery voltage detection circuit continuously detects the battery voltage when the lamp is turned on. However, if a lowering of the battery voltage is detected, the operation of the lamp is stopped. When switch 14 is turned ON, a LOW level input is applied to the second NOT input of AND gate 22. At the same time, if a LOW level indication signal i, representative of normal operation of the battery, is produced, then the HIGH level output signal from the third C-MOS inverter stage, comprised of transistors 7 and 9, is inverted by inverter 21, and applied as a LOW level signal to the NOT input of AND gate 22. In response to both LOW level inputs being applied to the respective NOT inputs of AND gate 22, a HIGH level control signal is applied to the lamp 15 to thereby energize same. Once the switch 14 is again opened, a HIGH level input will be applied to the NOT input of AND gate 22 to thereby turn OFF the lamp 15. Moreover, if the lamp is being operated, and the voltage detection circuit detects a drop in the voltage delivered by the battery 4, the output signal of the third C-MOS inverter stage will change to a LOW level signal, and thereby cause a HIGH level signal to be applied to a NOT input of AND gate 22 and thereby turn OFF lamp 15. As is depicted in the embodiment illustrated in FIG. 5, by applying a reset signal to the latch circuit 20, an indication signal is not inadvertently produced as a result of a lowering of the voltage characteristic in response to the additional load placed upon the battery by the energizing of the lamp.

By utilizing the embodiment illustrated in FIG. 8, it is possible that the lamp of a timepiece will not be operated at low temperatures even though the battery is not in its last state of discharge which might discourage a person from using his wristwatch in low temperature environments. However, as a practical matter, the wearer's body warmth would prevent the temperature of the timepiece from reaching the lower climate temperature and thereby avoid such a problem. Accordingly, a silver oxide battery having an NaOH electrolyte and a small self-discharge characteristic can be utilized for a long period of time in a timepiece having a lamp.

Accordingly, the instant invention is characterized by a battery monitoring circuit that avoids the inadvertent indication of impending failure of the battery when a lamp is lit, an alarm is actuated or a secondary function is performed in the timepiece. The battery monitoring circuit of the instant invention provides for more reliable operation of a wristwatch and prevents a battery from being unnecessarily changed before same is at the stage of impending failure.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece including a battery for producing a supply voltage and a battery detection circuit for detecting when the supply voltage of said battery falls below a predetermined level and in response thereto produces a detection signal, the improvement comprising monitoring means for producing an indication signal in response to said detection signal being applied thereto, a load means adapted to be selectively coupled to said battery and in response thereto place an additional load thereon, and inhibit means coupled to said battery detection circuit and said monitoring means, said inhibit means being further coupled to said load means for inhibiting said detection signal from being applied to said monitoring means when said load means is coupled to said battery.

2. An electronic timepiece as claimed in claim 1, and including sampling means for selectively applying a sampling signal to said battery detection circuit and monitoring means for short intervals of time to thereby effect detection by said battery detection circuit only during said short intervals of time.

3. An electronic timepiece as claimed in claim 2, wherein said inhibit means includes a gate and is disposed intermediate said load means and said battery detection circuit for receiving said sampling signal and for applying same to said battery detection circuit and said monitoring means in order to detect said voltage level of said battery, said inhibit means being further adapted to inhibit said sampling signal from being applied to at least one of said battery detection circuit means and said monitoring means in response to said load being selectively coupled to said battery, to thereby prevent said monitoring means from producing an indication signal when said load is placed upon said battery.

4. An electronic timepiece as claimed in claim 3, wherein said battery detection circuit includes at least one stage coupled to said battery for detecting a drop in the supply voltage below a predetermined level and for producing a pre-indication signal in response thereto, said first stage being coupled to said inhibit means for selectively preventing said battery detection means from detecting the level of said supply voltage in the absence of a sampling signal applied thereto.

5. An electronic timepiece as claimed in claim 4, wherein said monitoring means includes a latch means coupled to said battery detection circuit for storing therein said pre-indication signal in response to said sampling pulse being applied thereto.

6. An electronic timepiece as claimed in claim 2, wherein said battery detection circuit includes at least one stage coupled to said battery for detecting a drop in the supply voltage below a predetermined level and for producing a pre-indication signal in response thereto, said sampling means being coupled to the first stage of said battery detection circuit for applying said sampling signal to said battery detection circuit so that a pre-indication signal, representative of the voltage level of the battery, is produced by the battery detection circuit during the interval of said sampling signal applied thereto.

7. An electronic timepiece as claimed in claim 6, wherein said monitoring means includes a latch means for reading-in and temporarily storing said pre-indication signal produced by said battery detection circuit in response to said sampling signal being applied thereto, said inhibit means being coupled intermediate said load means and said latch means for detecting when said load means is selectively coupled to said battery and for resetting said latch means at least until said load means is no longer coupled to said battery.

8. An electronic timepiece as claimed in claim 6, wherein said load means is an alarm, said monitoring means includes a latch means for storing said pre-indication signal when a sampling pulse is applied to said battery detection circuit, and said inhibit means is coupled intermediate said load means and said latch means for resetting said latch means in response to said alarm means being coupled to said battery, said inhibit means being further adapted to reset said latch means for an interval of time after said alarm means is no longer coupled to said battery at least equal to the interval of time that said battery is selectively coupled to said battery.

9. An electronic timepiece as claimed in claim 7, wherein said load means includes a switch and a load device, said inhibit means being coupled to said switch for detecting when said switch couples said load means to said battery and in response thereto for applying a reset signal to said latch means to reset said latch means, and gate means coupled to said battery detection circuit for receiving said pre-indication signal produced thereby and said reset signal applied to said latch circuit, said gate means, in response to the absence of one of a reset signal applied thereto and a pre-indication signal representative of a drop in the voltage level of the battery being adapted to gate a cut-off signal to said load device.

10. An electronic timepiece as claimed in claim 3, wherein said load means is an alarm.

11. An electronic timepiece as claimed in claim 2, wherein said load means is a lamp.

* * * * *